United States Patent [19]

Arldt et al.

[11] Patent Number: 4,678,175

[45] Date of Patent: Jul. 7, 1987

[54] SHEET MONEY FEEDING MACHINE WITH IMPROVED SEPARATION MEANS

[75] Inventors: Brian D. Arldt, Austin, Tex.; Jonathon T. Loeb, Concord; Joseph C. Miller, Huntersville, both of N.C.; Hossein B. Parsapour, Darnestown, Md.; Fred H. Rascoe, III; Don W. Woodward, both of Charlotte, N.C.

[73] Assignee: International Business Machines Corporation, Armonk, N.Y.

[21] Appl. No.: 894,707

[22] Filed: Aug. 8, 1986

Related U.S. Application Data

[63] Continuation of Ser. No. 798,777, Nov. 18, 1985, abandoned.

[51] Int. Cl.[4] ..... B65H 3/04

[52] U.S. Cl. ..... 271/34; 271/3.1; 271/154; 271/157; 271/161; 271/169

[58] Field of Search ..... 271/3.1, 34, 126, 127, 271/147, 154, 157, 161, 166, 169

[56] References Cited

U.S. PATENT DOCUMENTS

| | | | |
|---|---|---|---|
| 1,392,750 | 10/1921 | Fink . | |
| 1,490,070 | 4/1924 | Korth | 271/161 X |
| 2,378,306 | 6/1945 | Leonhart | 271/32 |
| 2,692,774 | 10/1954 | Sidman | 271/133 |
| 2,827,288 | 3/1958 | Geisler | 271/161 X |
| 3,285,604 | 11/1966 | Parker | 271/133 |
| 3,627,307 | 12/1971 | van der Does | 271/3 |
| 4,183,517 | 1/1980 | Hageman et al. | 271/150 |
| 4,349,186 | 9/1982 | Nakamura | 271/161 X |
| 4,447,053 | 5/1984 | Wager | 271/147 X |
| 4,529,189 | 7/1985 | Konishi | 271/161 X |

FOREIGN PATENT DOCUMENTS

| | | | |
|---|---|---|---|
| 553181 | 5/1977 | U.S.S.R. | 271/166 |

*Primary Examiner*—Richard A. Schacher
*Attorney, Agent, or Firm*—Karl O. Hesse

[57] ABSTRACT

A money feeding machine having a friction feed mounted to feed from the top of a stack of money is disclosed. The stack of money is contained within a cassette having a moveable bottom. The bottom of the cassette is raised by a motor as money is fed from the top of the stack in order to maintain the top of the stack of money substantially at the top of the cassette and available for feeding by the friction feed. Ramps are mounted a predetermined distance down from the top of the cassette to squeeze sheets of money inwardly and cause them to bow upwardly as they are pushed up by the motor. The ramps cause blocks of mint money to be separated into a short loose stack of sheets above the ramps for reliable feeding by the friction feed.

5 Claims, 2 Drawing Figures

SHEET MONEY FEEDING MACHINE WITH IMPROVED SEPARATION MEANS

BACKGROUND OF THE INVENTION

1. Field of the Invention

The invention relates to sheet money feeding apparatus and more specifically to automatic money dispensing machines which must accurately and reliably feed a precise number of sheets of money as specified by a user without regard to the new or used condition of the money.

2. Prior art

Both the owners and the users of automatic money dispensing machines prefer that mint new money be dispensed from their machines. A money cassette will hold approximately 30% more mint money than it will hold used money so the cost of replentishing the money supply is lower when new money is dispensed. Customers also prefer to receive crisp new money instead of used money which may be crumpled and dirty. Furthermore used money often arrives at the owners premises in dirty condition with tape or staples which must be removed for reliable feeding by any known machines. This labor raises the cost of using used money in a money dispensing machine. However, in order to provide uninterrupted service in those instances when mint money is not available, a desireable money dispensing machine must be able to dispense used money as well as mint new money.

A number of different apparatus is known in the prior art for feeding sheets of money. An example is U.S. Pat. No. 4,221,376 assigned to the assignee of this invention. Apparatus of the type described in U.S. Pat. No. 4,221,376 has proven to be able to accurately and reliably feed sheets of mint new money but in some environments it has been found that apparatus of the type disclosed in U.S. Pat. No. 4,459,052 feeds used money more accurately and reliably. The apparatus of the type disclosed in U.S. Pat. No. 4,459,052 however suffers from an inability to reliably separate and accurately feed sheets of mint money which are still formed into blocks of sheets or which have under the influence of humidity and warm temperatures reformed themselves into blocks of sheets which adhere to one another.

Accordingly, we have invented novel modifications to the apparatus of the type disclosed in U.S. Pat. No. 4,459,052 in order to improve its ability to accurately and reliably feed mint new money. Others have been unsuccessfull in their attempt overcome this inability of the apparatus to accurately and reliably feed mint money. Their solution has been to play down this deficiency and emphasize the ability of the apparatus to feed used money. Where mint money must be fed, others have suggested that owners feed the mint money through money counting apparatus of the type well known in banks and other financial institutions, thereby effectively converting the mint money into used money under controlled conditions. The requirement to feed mint money through a counting machine several times is a significant cost of labor and capital similar to the need to remove tape and staples from real used money.

Accordingly, the prior art lacks a single apparatus which can accurately and reliably dispense both used and mint new banknotes interchangeably.

SUMMARY OF THE INVENTION

This invention has solved the mint money feeding problem of the apparatus of the type disclosed in U.S. Pat. No. 4,459,052 by providing an inexpensive and effective sheet block separating ramp means spaced down from the top of the stack of money being fed. The ramp means squeezes each sheet of money inwardly as it is raised toward the friction feed means, causing the sheets to bow upwardly and to separate from underlying sheets. After being squeezed and caused to bow upwardly and separate from its underlying sheet, each sheet of money passes the top of the ramp means and again lies flat as part of a short loose stack of separate sheets of money which can then be reliably and accurately fed by the friction feed means which has proven to be so effective in feeding used notes.

In the preferred embodiment of the invention, the block separating ramp means are implemented in the form of two ramps in series to twice squeeze and bow notes and improve the likelihood that the position of a sheet in the short stack above the ramp means is horizontally displaced from the position of overlying and underlying adjacent sheets which reduces the likelihood that two or more sheets will re-adhere to each other and feed at one time.

BRIEF DESCRIPTION OF THE DRAWINGS

The above mentioned and other features and objects of this invention and the manner of obtaining them will become more apparent and the invention itself will best be understood by reference to the following description of embodiments taken in conjunction with the accompanying drawings, the description of which follows.

DESCRIPTION OF PREFERRED EMBODIMENTS

Figure 1:
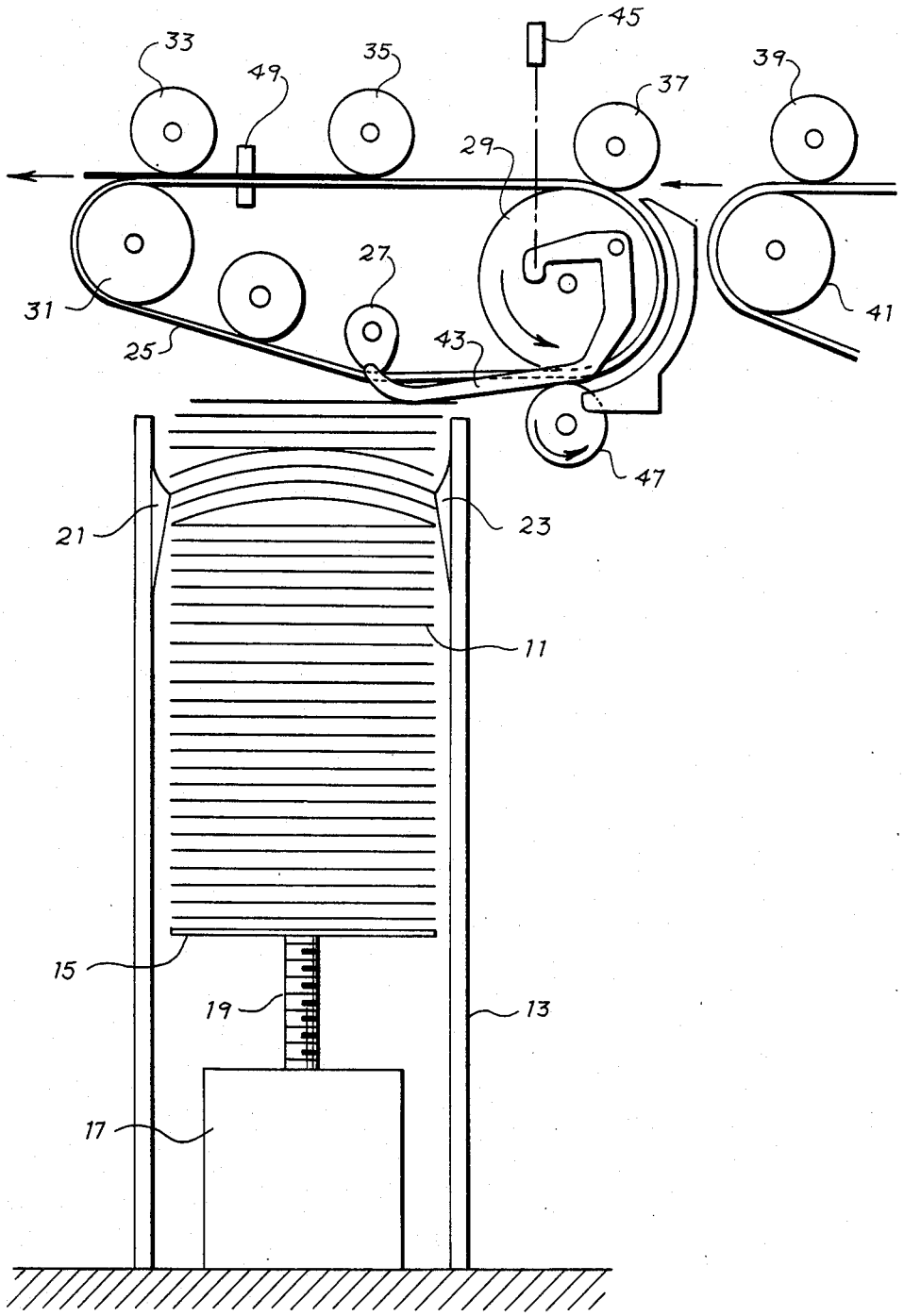
FIG. 1 illustrates a cutaway side view of the money feeding machine having a pair of ramps disposed to squeeze the sheets of money inwardly in a direction parallel to the direction of the feed.

Referring now to FIG. 1, there is shown an embodiment of the invention in a side view. A stack of money 11 is disposed into a cassette 13. Cassette 13 has a moveable floor or money stack support 15 which is raised and lowered by motor 17 via mechanism 19. Mechanism 19 can be a lead screw, a connecting rod and crank, or other similar mechanism.

Cassette 13 has a rectangular horizontal cross section which is larger than the length and width of a sheet of money. Two opposing side walls of the cassette are shown. Each side wall shown has a ramp 21, 23 mounted near the top of the cassette. It has been found that placement of the top of each ramp 21, 23 at between 5 and 15 millimeters down from the top of the cassette results in the formation of a nicely separated stack of money above the ramps. This stack is small and loose enough to prevent re-blocking in high humidity and temperature conditions, yet large enough to reliably feed without catching at the top of ramp means 23. The ramps 21, 23 have inwardly tapering flat lower surfaces and arcuately tapering upper surfaces which join to form a peak as shown. The arcuate upper surface allows the stack of money to be pushed back down into the cassette preparatory to removing the cassette from the machine as desired. The ramps may be of any width but it has been found that a width of approximately 13 millimeters provides good separation without excessive sheet deforming force.

Feeding is accomplished by belt 25 which traverses pulleys 27, 29, and 31. Rollers 33, 35, and 37 also contact belt 25 to carry a note fed from stack 11 to an escrow area, not shown, where it is held until the proper number of sheets of money have been fed. Rolls 39 and 41 comprise the feeding mechanism from an adjacent stack of money, perhaps of a different denomination which feed sheets of money into the nip of rolls 29, 37 for transport to the escrow.

The stack of money 11 is normally held away from belt 25 by actuator arms 43 which hold the sheets pressed down and away from belt 25. When money is to be fed, actuator arm 43 is raised by magnet 45 allowing the top of money stack 11 to contact belt 25, which by friction engages the top most sheet and pulls it into the nip between roll 29 and roll 47. Both roll 29 and roll 47 rotate counter clockwise so that roll 47 tends to restrain underlying but separated notes from being fed. As a number of notes are fed from the top of stack 11, belt 25 will soon no longer contact the top of stack 11 and although belt 25 is rotated and actuator arm 43 retracted, money will not be fed and therefore not sensed at detector 49. If a predetermined amount of time passes while belt 25 rotates without a sheet of money being fed, motor 17 is activated by a controlling computer to drive lead screw 19 and raise bottom 15 of the cassette 13. As soon as a sheet is fed, motor 17 is turned off. If ever more than one sheet is fed at one time, the multiple sheets are diverted to a reject bin, also not shown, and are not issued to the user. If multiple sheets are several times issued, the computer again turns on motor 17 but this time drives lead screw 19 in the opposite direction to lower the pressure on the stack of money 11 because it may be that too many sheets have been forced past the separator ramps.

Figure 2:
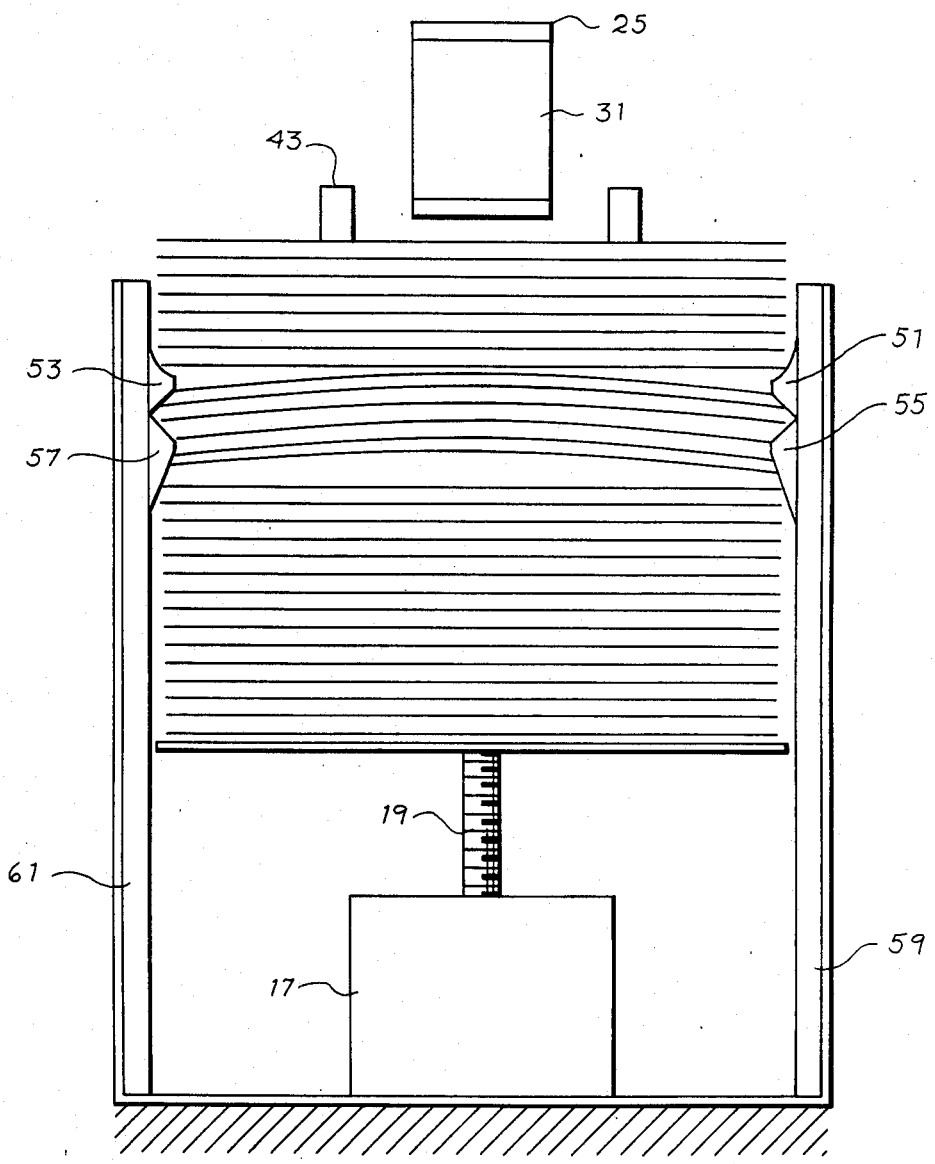
FIG. 2 shows an end view of the preferred embodiment wherein the stack of money is squeezed inwardly in a direction transverse to the direction in which sheets of money will be fed from the top of the stack.

FIG. 2 shows a preferred embodiment including the same motor 17, lead screw 19, feed wheel 31, belt 25 and actuators 43. In this embodiment, however, the notes are squeezed at their ends to cause them to bow upward and separate, the squeezing occurring in a direction transverse to the direction in which they will be fed.

In FIG. 2, sheet separating ramps 51 and 53 are an integral part of replaceable note width guides 59 and 61. These width guides 59 and 61 are available in different dimensions to accommodate a longer or shorter banknote, such as occurrs in the currency of different countries. In addition to the ramps 51 and 53, serial ramps 55 and 57 are located so as to act in series with ramps 51 and 53 to twice bow the notes as they are pushed up in the cassette. In addition the ramps 51, 55 molded into guide 59 can be slightly lower than the corresponding ramps 53, 57 molded into guide 61 so as to cause the notes to move from one side to the other as they are pushed up in the cassette. The side to side motion causes them to be horizontally displaced in the loose stack formed at the top of the cassette and less likely to re-block in high temperature and humidity.

Having described our invention in light of the accompanying drawings, it will be seen by those skilled in the art that various changes in form, detail, and application may be made without departing from the spirit and scope of the invention. For example, the ramps 51 and 53 may be mounted as an integral part of the money guides or may be mounted directly to the cassette sidewalls. Likewise although a belt feed 25 and actuators 43 are taught in the specifications, alternate and equivalent forms of friction feeds may be substituted without departing from the spirit and scope of the invention which involves using ramps near but not at the point of feeding, to break up blocks of sheets in a stack of sheets being raised to a friction feed.

What is claimed is:

1. A sheet money feeding machine comprising: a friction feed means disposed above a cassette, said friction feed means having an actuator for selectively feeding a top sheet of money from a stack of money in said cassette;

said cassette having a pair of sidewalls and a moveable bottom, said bottom being connected to a motor for raising said bottom as sheets of money are fed from the top of said stack of money in said cassette, so as to maintain said top of said stack of money substantially at the top of said cassette;

an inwardly projecting ramp extending from each of said sidewalls for squeezing each sheet inwardly and causing it to bow upwardly and be separated from the immediately underlying sheet, as said stack of money is raised in said cassette, said ramp means being spaced from said top of said cassette for permitting those sheets of money which have passed said ramp means to again lie substantially flat in preparation for feeding by said friction feed means.

2. The money feeding machine of claim 1 wherein each of said ramp means comprises an upper ramp and a lower ramp for causing said sheets of money to be twice squeezed and bowed upwardly.

3. The money feeding machine of claim 1 wherein one of said ramp means is mounted more closely to the top of said cassette so as to cause said sheets of money to move from one of said opposing sidewalls to the other of said opposing sidewalls as it passes the tops of said ramp means to improve the separation of said sheets of money.

4. The money feeding machine of claim 2 wherein said individual sheets of said stack of money are squeezed inwardly in a direction transverse to the direction in which each sheet of money will be fed from the top of said stack of money.

5. The sheet money feeding machine of claim 1 wherein said ramp means are mounted onto two opposing sidewalls of said cassette for squeezing said stack of money inwardly in a direction parallel to the direction in which sheets of money are fed from the top of said stack of money.

* * * * *